US012716424B2

(12) United States Patent
Nichols et al.

(10) Patent No.: US 12,716,424 B2
(45) Date of Patent: Aug. 25, 2026

(54) AIRCRAFT GAS TURBINE ENGINE IMPELLER WITH A TRAILING EDGE THAT IS NON-LINEAR OR ANGLED OR IRREGULARLY-SHAPED

(71) Applicant: Pratt & Whitney Canada Corp., Longueuil (CA)

(72) Inventors: Jason Nichols, Mississauga (CA); Hien Duong, Mississauga (CA); Hong Yu, Oakville (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 56 days.

(21) Appl. No.: 18/793,201

(22) Filed: Aug. 2, 2024

(65) Prior Publication Data

US 2026/0036133 A1 Feb. 5, 2026

(51) Int. Cl.
*F04D 29/28* (2006.01)
*F04D 17/10* (2006.01)
*F04D 29/42* (2006.01)

(52) U.S. Cl.
CPC ..... *F04D 29/284* (2013.01); *F04D 17/10* (2013.01); *F04D 29/422* (2013.01)

(58) Field of Classification Search
CPC ..... F04D 29/284; F04D 17/10; F04D 29/422
See application file for complete search history.

(56) References Cited

U.S. PATENT DOCUMENTS 5,595,473 A * 1/1997 Nagaoka ..... F04D 1/06 415/199.1
11,143,201 B2 * 10/2021 Duong ..... F02C 3/08
11,835,057 B2 12/2023 Fujita et al.
2001/0033792 A1 10/2001 Nagaoka et al.
2014/0050568 A1 2/2014 Brinkert et al.
2017/0350410 A1 * 12/2017 Saito ..... F04D 29/30
2020/0291959 A1 9/2020 Duong et al.
2023/0258197 A1 8/2023 Iwakiri et al.
2024/0240647 A1 7/2024 Kanzaka et al.

FOREIGN PATENT DOCUMENTS

CA 3123121 A1 3/2022
EP 1757814 A1 2/2007
JP 2015194091 A 11/2015
WO 2021192019 A1 9/2021

OTHER PUBLICATIONS

Search Report issued in European Patent Application No. 25193565.6; Date of Mailing Jan. 13, 2026 (11 pages).

* cited by examiner

*Primary Examiner* — Sabbir Hasan
(74) *Attorney, Agent, or Firm* — CANTOR COLBURN LLP

(57) ABSTRACT

A centrifugal compressor assembly of a gas turbine engine of an aircraft is provided. The centrifugal compressor assembly includes an impeller having a hub, vanes and a shroud surrounding the hub and the vanes to form a flow path from an inducer portion at an upstream side of the impeller to an exducer portion at an impeller exit. A diffuser is configured to direct compressed air from the impeller exit to a downstream combustor. The diffuser includes a diffuser ring proximate to the impeller exit. Each vane includes, at the impeller exit, a trailing edge which is at least one of non-linear and angled. The shroud includes a sloped trailing edge portion adjacent to the trailing edge of each vane, and the diffuser ring includes a sloped surface adjacent to the sloped trailing edge portion of the shroud.

9 Claims, 5 Drawing Sheets

AIRCRAFT GAS TURBINE ENGINE IMPELLER WITH A TRAILING EDGE THAT IS NON-LINEAR OR ANGLED OR IRREGULARLY-SHAPED

BACKGROUND

Exemplary embodiments of the present disclosure relate generally to impellers and, in some embodiments, to an impeller of a centrifugal compressor of a gas turbine engine of an aircraft engine with a trailing edge that is non-linear or angled or irregularly-shaped.

Centrifugal compressors are widely used in aerospace and industrial applications. An impeller of a centrifugal compressor can generate large increases in the total pressure of a working fluid by way of a radius change from the inlet of the impeller to the exit of the impeller. A diffuser is typically arranged downstream from the exit of the impeller and is used to convert kinetic energy from the impeller in the form of a velocity of the working fluid to potential energy in the form of static pressure of the working fluid. Diffuser performance is often strongly affected by impeller exit conditions.

Accordingly, a continuing need exists for improvements in centrifugal compressors and diffusers that exhibit improved impeller exit conditions and thus diffuser performance.

BRIEF DESCRIPTION

A centrifugal compressor assembly of a gas turbine engine of an aircraft is provided. The centrifugal compressor assembly comprises an impeller comprising a hub, vanes and a shroud surrounding the hub and the vanes to form a flow path from an inducer portion at an upstream side of the impeller to an exducer portion at an impeller exit. A diffuser is configured to direct compressed air from the impeller exit to a downstream combustor. The diffuser includes a diffuser ring proximate to the impeller exit. Each vane comprising, at the impeller exit, a trailing edge which is at least one of non-linear and angled. The shroud comprises a sloped trailing edge portion adjacent to the trailing edge of each vane, and the diffuser ring comprises a sloped surface adjacent to the sloped trailing edge portion of the shroud.

In addition to one or more of the features described above, or as an alternative to any of the foregoing embodiments, the trailing edge of each vane is non-linear with at least one of quadratic and high-order curvatures.

In addition to one or more of the features described above, or as an alternative to any of the foregoing embodiments, the trailing edge of each vane has a varying tip radius.

In addition to one or more of the features described above, or as an alternative to any of the foregoing embodiments, the trailing edge of each vane is radially outwardly angled from the hub to a distal tip of the sloped trailing edge portion of the shroud.

In addition to one or more of the features described above, or as an alternative to any of the foregoing embodiments, the trailing edge of each vane is concave and radially outwardly angled from the hub to a distal tip of the sloped trailing edge portion of the shroud.

In addition to one or more of the features described above, or as an alternative to any of the foregoing embodiments, the trailing edge of each vane is concave.

In addition to one or more of the features described above, or as an alternative to any of the foregoing embodiments, the trailing edge of each vane is convex.

In addition to one or more of the features described above, or as an alternative to any of the foregoing embodiments, the sloped trailing edge portion of the shroud is sloped toward the trailing edge of each vane.

In addition to one or more of the features described above, or as an alternative to any of the foregoing embodiments, the diffuser ring comprises the sloped surface, which is radially outwardly angled away from the sloped trailing edge portion of the shroud, and an annular surface opposite the trailing edge of each vane.

In addition to one or more of the features described above, or as an alternative to any of the foregoing embodiments, the trailing edge of each vane is at least one of radially outwardly angled from the hub to a distal tip of the sloped trailing edge portion of the shroud, concave and radially outwardly angled from the hub to a distal tip of the sloped trailing edge portion of the shroud, concave and convex, the sloped trailing edge portion of the shroud is sloped toward the trailing edge of each vane, and the diffuser ring comprises the sloped surface, which is radially outwardly angled away from the sloped trailing edge portion of the shroud, and an annular surface opposite the trailing edge of each vane.

According to another non-limiting embodiment, a centrifugal compressor assembly of a gas turbine engine of an aircraft is provided. The centrifugal compressor assembly comprises an impeller including a hub, vanes and a shroud surrounding the hub and the vanes to form a flow path from an inducer portion at an upstream side of the impeller to an exducer portion at an impeller exit. A diffuser is configured to direct compressed air from the impeller exit to a downstream combustor. The diffuser comprises a diffuser ring proximate to the impeller exit. Each vane comprises, at the impeller exit, an irregularly-shaped trailing edge. The shroud comprises a sloped trailing edge portion adjacent to the irregularly-shaped trailing edge of each vane, and the diffuser ring comprises a sloped surface adjacent to the sloped trailing edge portion of the impeller shroud.

In addition to one or more of the features described above, or as an alternative to any of the foregoing embodiments, the irregularly-shaped trailing edge of each vane comprises an angled portion and a flat portion.

In addition to one or more of the features described above, or as an alternative to any of the foregoing embodiments, the irregularly-shaped trailing edge of each vane comprises a curved portion and a flat portion.

In addition to one or more of the features described above, or as an alternative to any of the foregoing embodiments, the irregularly-shaped trailing edge of each vane comprises a curved portion and flat portions at either side of the curved portion.

In addition to one or more of the features described above, or as an alternative to any of the foregoing embodiments, the sloped trailing edge portion of the shroud is sloped toward the irregularly-shaped trailing edge of each vane.

In addition to one or more of the features described above, or as an alternative to any of the foregoing embodiments, the diffuser ring comprises the sloped surface, which is radially outwardly angled away from the sloped trailing edge portion of the shroud, and an annular surface opposite the irregularly-shaped trailing edge of each vane.

In addition to one or more of the features described above, or as an alternative to any of the foregoing embodiments, the irregularly-shaped trailing edge of each vane comprises at least one of an angled portion and a flat portion, a curved portion and a flat portion and a curved portion and flat portions at either side of the curved portion, the sloped trailing edge portion of the shroud is sloped toward the irregularly-shaped trailing edge of each vane, and the diffuser ring comprises the sloped surface, which is radially outwardly angled away from the sloped trailing edge portion of the shroud, and an annular surface opposite the irregularly-shaped trailing edge of each vane.

According to yet another non-limiting embodiment, a centrifugal compressor assembly of a gas turbine engine of an aircraft comprises an impeller. The impeller comprises a hub, vanes, and a shroud surrounding the hub and the vanes to form a flow path from an inducer portion at an upstream side of the impeller to an exducer portion at an impeller exit. Each vane comprises, at the impeller exit, a trailing edge having a trailing edge radius differing from a trailing edge radius of the trailing edge of at least one or more other vanes.

In addition to one or more of the features described above, or as an alternative to any of the foregoing embodiments, the trailing edge radius of the trailing edge of each vane differs from the trailing edge radius of the trailing edge of at least one neighboring vane.

In addition to one or more of the features described above, or as an alternative to any of the foregoing embodiments, the centrifugal compressor assembly further comprises a diffuser configured to direct compressed air from the impeller exit to a downstream combustor. The diffuser comprises a diffuser ring proximate to the impeller exit. The shroud comprises a sloped trailing edge portion adjacent to the trailing edge of each vane. The sloped trailing edge portion is sloped toward the trailing edge of each vane. The diffuser ring comprises a sloped surface adjacent to the sloped trailing edge portion of the shroud. The sloped surface is radially outwardly angled away from the sloped trailing edge portion of the shroud, and an annular surface opposite the trailing edge of each vane.

These and other advantages and features will become more apparent from the following description taken in conjunction with the drawings.

BRIEF DESCRIPTION OF THE DRAWINGS

The following descriptions should not be considered limiting in any way. With reference to the accompanying drawings, like elements are numbered alike.

Figure 1:
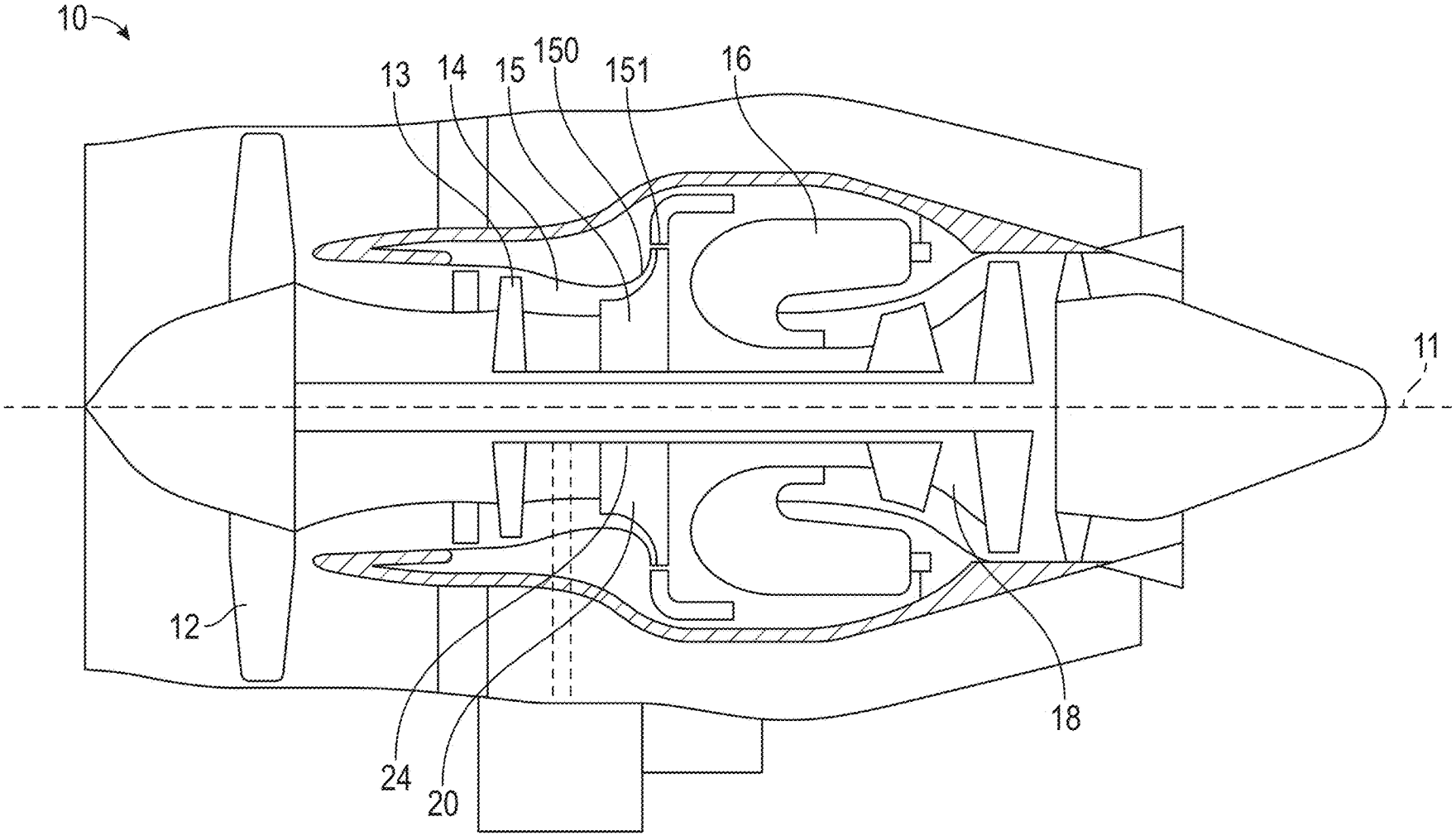
FIG. 1 (Prior Art)
FIG. 1 is a schematic cross-sectional view of a prior art gas turbine engine in accordance with embodiments.

These and other advantages and features will become more apparent from the following description taken in conjunction with the drawings.

DETAILED DESCRIPTION

A detailed description of one or more embodiments of the disclosed apparatus and method are presented herein by way of exemplification and not limitation with reference to the Figures.

As noted above, centrifugal compressors are widely used in aerospace and industrial applications. An impeller of a centrifugal compressor can generate large increases in the total pressure of a working fluid by way of a radius change from the inlet of the impeller to the exit of the impeller. A diffuser is typically arranged downstream from the exit of the impeller and is used to convert kinetic energy from the impeller in the form of a velocity of the working fluid to potential energy in the form of static pressure of the working fluid. Diffuser performance is often strongly affected by impeller exit conditions. For example, maximum diffusion in the diffuser will occur with smooth inlet profiles. Achieving such smooth inlet profiles can be difficult however for several reasons. These reasons include, but are not limited to, impeller tip clearance between the impeller tip and the shroud, strong curvature in the impeller near the shroud and shock and/or boundary layer interactions.

Accordingly, a continuing need exists for improvements in centrifugal compressors and diffusers that exhibit improved impeller exit conditions and thus diffuser performance.

As will be described below, a centrifugal compressor is provided with improved impeller exit flow conditions achieved by a flattened pressure profile. The flattened pressure profile can be obtained by adjusting an impeller trailing edge radius to cater for deficits in total pressures at the impeller exit. The flattened pressure profile can also be obtained by raising a shroud side of the impeller trailing edge radius to increase blade speed of the shroud side relative to the hub and thus generate higher pressure so that the resulting profile will be more uniform and boost the performance of the diffuser. Geometries will be generally dependent on an amount of pressure to be recovered. Also, higher slopes on the trailing edge radius will be possible if the impeller has a large tip clearance, a small aspect ratio (i.e., ratio of length to radius) and/or a high specific speed (i.e., a high inlet relative Mach number). Further configurations can include a higher radius hub and linear, quadratic or higher order curves between the hub and the shroud. In addition, the trailing edge shape could be tailored to optimize diffuser performance. There can also be variations in trailing edge radii from blade-to-blade. The variation will create a slightly different pressure profile from each blade which can be used for mis-tuning wakes coming off the impeller. Still further configurations can exhibit modifications to the impeller shroud and the diffuser in conjunction with the non-linear or angled impeller trailing edge. For example, a higher radius impeller along the tip would serve to increase pressures while a sloped shroud paired with a cutback and/or angled diffuser ring will help guide flows into the diffuser.

Figure 2:
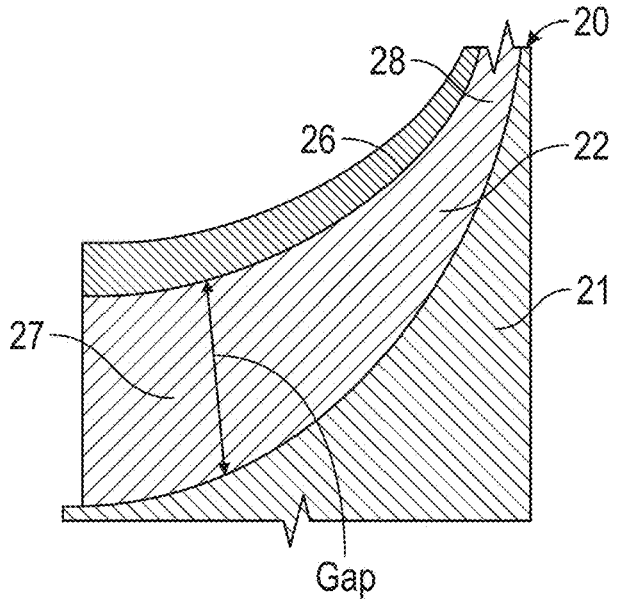
FIG. 2 (Prior Art)
FIG. 2 is a schematic cross-sectional view of a prior art impeller in accordance with embodiments.

FIGS. 1 and 2 illustrate a prior art turbofan gas turbine engine 10 of a type preferably provided for use in subsonic flight of an aircraft and a prior art impeller 20.

The gas turbine engine 10 generally includes in serial flow communication a fan 12 through which ambient air is propelled, a multistage compressor 14 for pressurizing the air having an axial compressor 13 and a centrifugal compressor 15, an impeller shroud 150, a diffuser 151, a combustor 16 and a turbine section 18. The impeller shroud 150 is adjacent to the centrifugal compressor 15 and forms a fluid flow path for air being compressed with the centrifugal compressor 15. The diffuser 151 is downstream from the centrifugal compressor 15 and directs compressed air from the centrifugal compressor 15 to the combustor 16. The compressed air is mixed with fuel and ignited is the combustor 16 for generating an annular stream of hot combustion gases. The turbine section 18 is configured to extract energy from the combustion gases. The center axis 11 of the engine 10 is also illustrated.

The centrifugal compressor 15 axially receives a compressible fluid, increases the pressure of the compressible fluid and conveys it in a substantially radial direction. The working or compressible fluid can be any fluid which can experience significant variations in density and in most instances is air or another gas. The centrifugal compressor 15 includes at least an impeller 20, which increases the pressure of the compressible fluid before conveying it downstream and the impeller shroud 150, which houses the impeller 20 and provides structure to the centrifugal compressor 15.

The impeller 20 can be any device which can rotate about a central axis so as to increase the pressure of the compressible fluid. The impeller 20 has an impeller hub 21 and multiple impeller vanes 22 extending from the impeller hub 21. The impeller 20 is mounted to a shaft 24 which rotates, along with the impeller 20, about a shaft axis that can be coaxial with center axis 11. The impeller shroud 150 houses or encloses the impeller 20 and includes a shroud body, which provides the impeller shroud 150 with structure and an ability to resist loads generated by the centrifugal compressor 15 when in operation. The impeller shroud 150 also has a shroud surface 26, which is exposed to the compressible fluid and which surrounds the impeller vanes 22. The shroud surface 26 and the impeller hub 21 respectively extend between an inducer portion 27 and an exducer portion 28.

Figure 3:
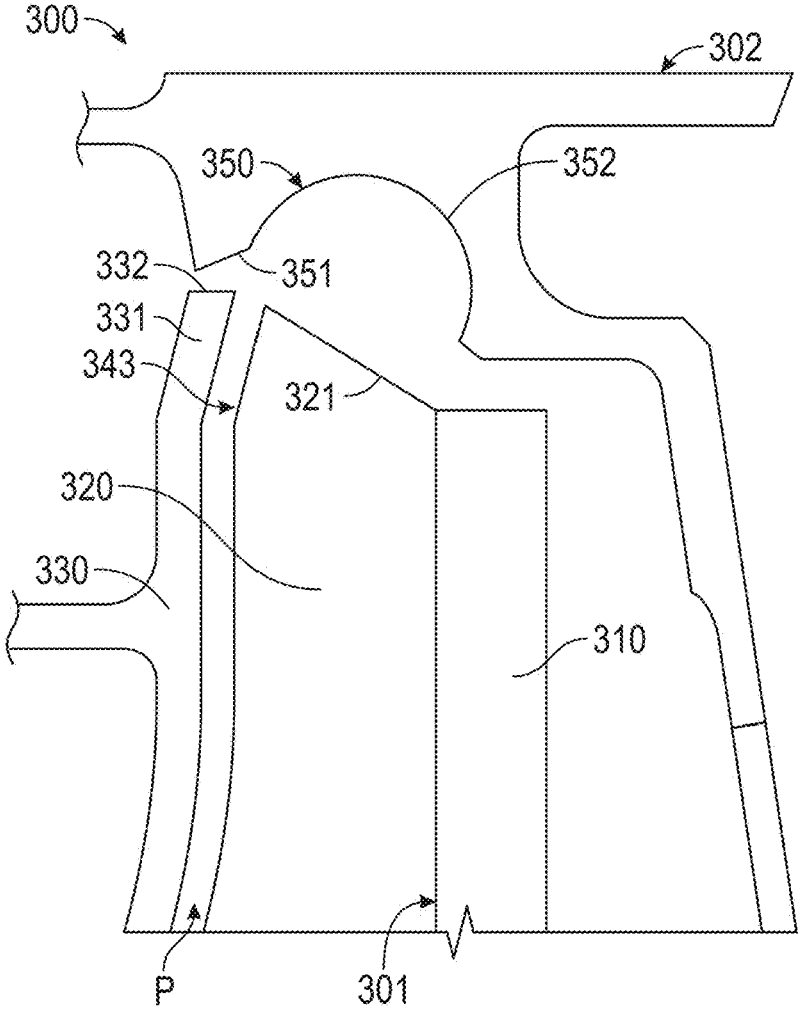
FIG. 3 is an enlarged side view of a centrifugal compressor assembly in accordance with embodiments.
Figure 4A:
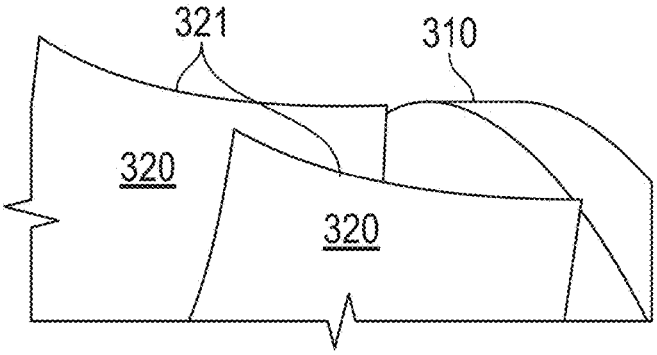
FIGS. 4A and 4B are perspective and side views of impeller vanes with angled and non-linear trailing edges in accordance with embodiments.
Figure 4B:
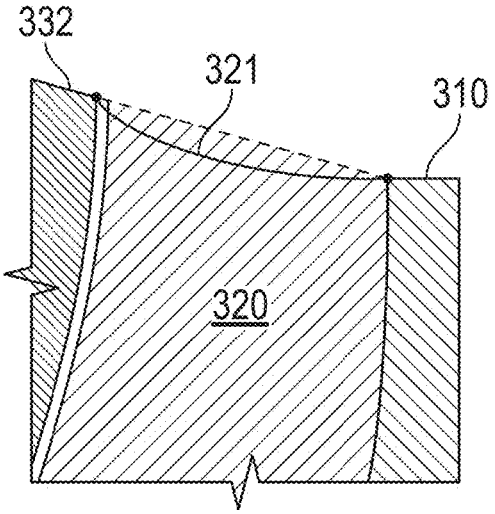
Figure 5A:
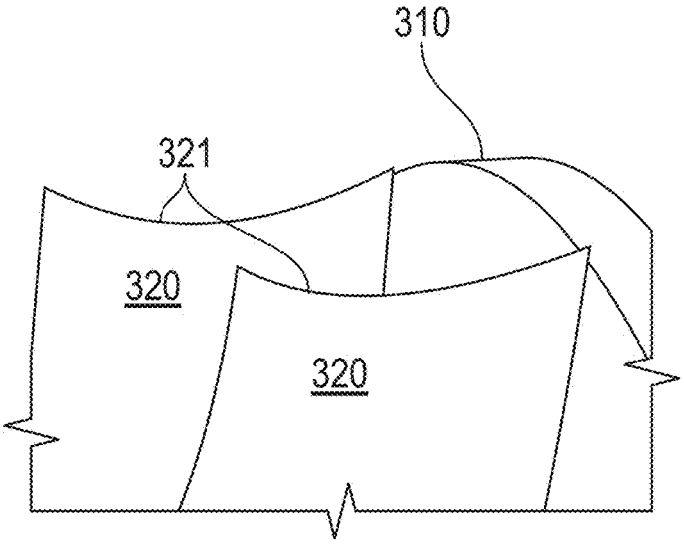
FIGS. 5A and 5B are perspective and side views of impeller vanes with concave trailing edges in accordance with embodiments.
Figure 5B:
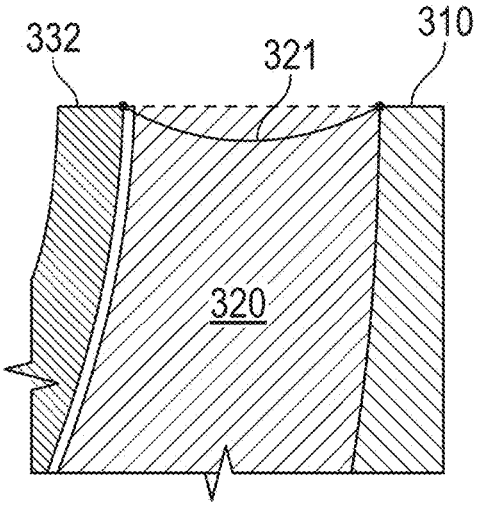
Figure 6A:
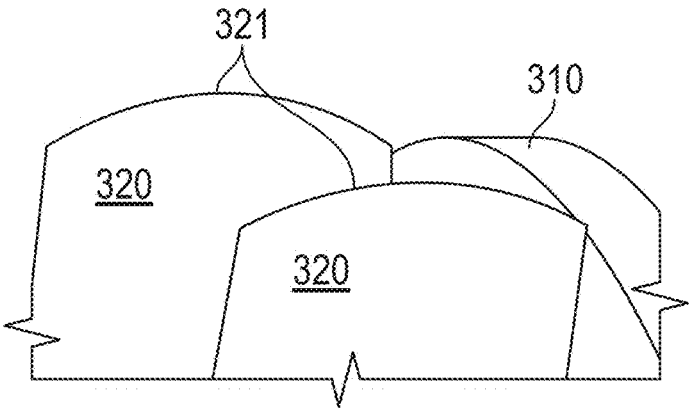
FIGS. 6A and 6B are perspective and side views of impeller vanes with convex trailing edges in accordance with embodiments.
Figure 6B:
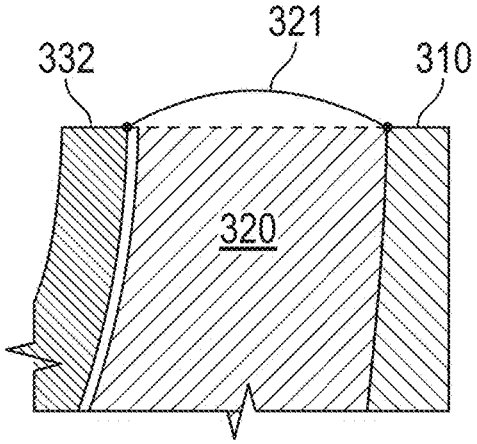
Figure 7:
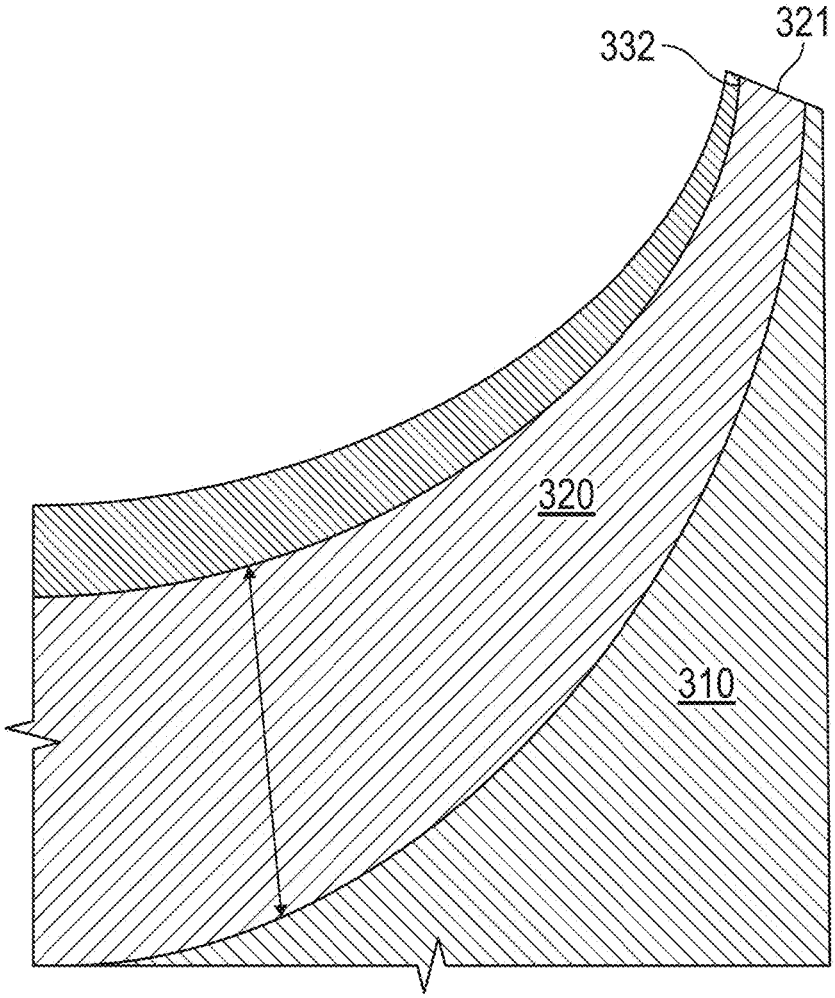
FIG. 7 is a side view of impeller vanes with angled trailing edges in accordance with embodiments.
Figure 8A:
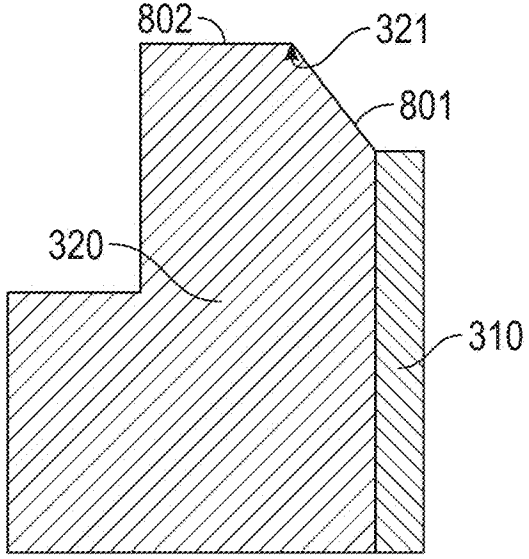
FIGS. 8A, 8B and 8C are side views of impeller vanes with irregularly-shaped trailing edges in accordance with embodiments.
Figure 8B:
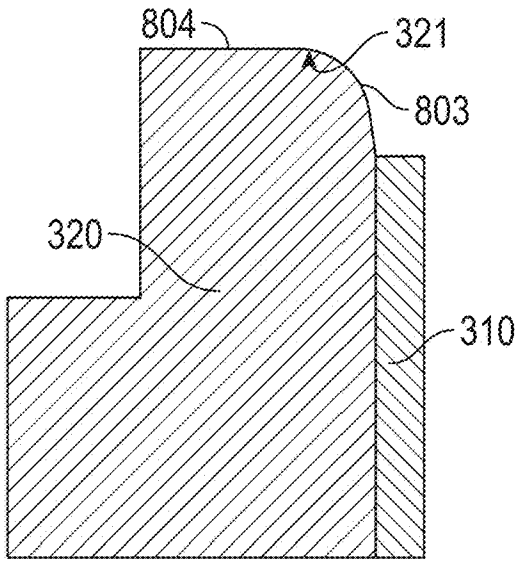
Figure 8C:
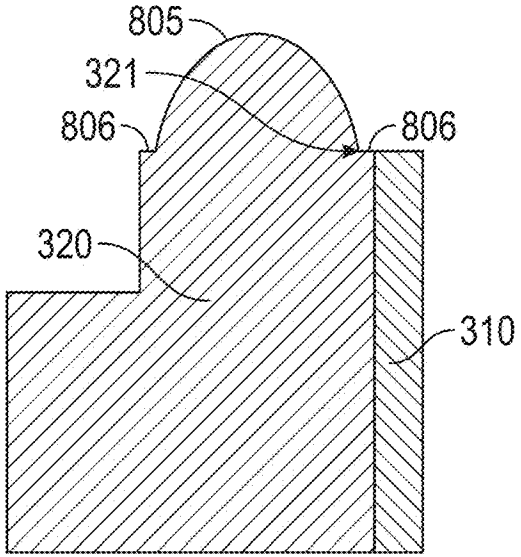

With continued reference to FIGS. 1 and 2 and with additional reference to FIG. 3 and to FIGS. 4A, 4B, 5A, 5B, 6A, 6B and 7 and to FIGS. 8A, 8B and 8C, a centrifugal compressor assembly 300 of a gas turbine engine of an aircraft, such as the centrifugal compressor 15 including the impeller 20 and the shroud 150 and the diffuser 151 of the gas turbine engine 10 of FIGS. 1 and 2, is provided. The centrifugal compressor assembly 300 is similar to the centrifugal compressor 15 including the impeller 20 and the shroud 150 and the diffuser 151 of the gas turbine engine 10 of FIGS. 1 and 2 except as described below.

The centrifugal compressor assembly 300 includes an impeller 301 and a diffuser 302. The impeller 301 includes an impeller hub 310, impeller vanes 320 and an impeller shroud 330 surrounding the impeller hub 310 and the impeller vanes 320 to form a flow path P from an inducer portion (see inducer portion 27 of FIG. 2) at an upstream side of the impeller 301 to an exducer portion (see exducer portion 28 of FIG. 2) at an impeller exit 343. The diffuser 302 is configured to direct compressed air from the impeller exit 343 to a downstream combustor 303. The diffuser 302 includes a diffuser ring 350 proximate to the impeller exit 343. Each impeller vane 320 includes, at the impeller exit 343, a trailing edge 321 that is at least one of non-linear (see FIGS. 4A, 4B, 5A, 5B, 6A and 6B) and angled (see FIG. 7) and/or irregularly-shaped (see FIGS. 8A, 8B and 8C).

As shown in FIG. 3, the impeller shroud 330 includes a sloped trailing edge portion 331 that is adjacent to and slightly separated from the trailing edge 321 of each impeller vane 320 and the diffuser ring 350 includes a sloped surface 351 that is adjacent to and slightly separated from the sloped trailing edge portion 331 of the impeller shroud 330. The sloped trailing edge portion 331 of the impeller shroud 330 can be sloped toward the trailing edge 321 of each impeller vane 320. The diffuser ring 350 can include the sloped surface 351, which is radially outwardly angled away from the sloped trailing edge portion 331 of the impeller shroud 330, and an annular surface 352 leading to the sloped surface 351 and being disposed opposite from the trailing edge 321 of each impeller vane 320.

As shown in FIGS. 4A, 4B, 5A, 5B, 6A and 6B, the trailing edge 321 of each impeller vane 320 can be non-linear with at least one of quadratic and high-order curvatures. That is, the trailing edge 321 of each impeller vane 320 can be concave and radially outwardly angled from the impeller hub 310 to a distal tip 332 (see FIG. 3) of the sloped trailing edge portion 331 of the impeller shroud 330 (see FIGS. 4A and 4B), the trailing edge 321 of each impeller vane 320 can be concave (see FIGS. 5A and 5B) and/or the trailing edge 321 of each impeller vane 320 can be convex (see FIGS. 6A and 6B). As shown in FIG. 7, the trailing edge 321 of each impeller vane 320 has a varying tip radius R with forward-to-aft axial position. That is, the trailing edge 321 of each impeller vane 320 can be radially outwardly angled from the impeller hub 310 to the distal tip 332 of the sloped trailing edge portion 331 of the impeller shroud 330. As shown in FIGS. 8A, 8B and 8C, the trailing edge 321 of each impeller vane 320 can be irregularly-shaped. That is, the trailing edge 321 of each impeller vane 320 can include an angled portion 801 and a flat portion 802 (see FIG. 8A), a curved portion 803 and a flat portion 804 (see FIG. 8B) and/or a curved portion 805 and flat portions 806 at either side of the curved portion 805 (see FIG. 8C).

Figure 9:
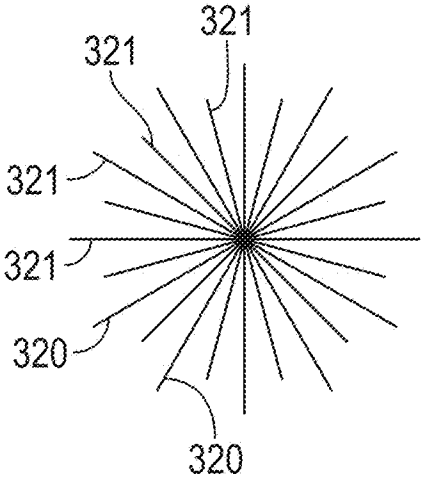
FIG. 9 is a schematic illustration of impeller vanes with varying tip radii in accordance with embodiments.

With continued reference to FIGS. 1 and 2 and with additional reference to FIG. 9, the trailing edge 321 of each impeller vane 320 can have a trailing edge radius differing from a trailing edge radius of the trailing edge 321 of at least one or more other impeller vanes 320. That is, the trailing edge radius of the trailing edge 321 of each impeller vane 320 can differ from the trailing edge radius of the trailing edge 321 of at least one neighboring impeller vane 320 (see FIG. 9.).

It is to be understood that although the embodiments of FIGS. 4A, 4B, 5A, 5B, 6A, 6B, 7, 8A, 8B, 8C and 9 are illustrated and described separately herein, this is not required and can be interchangeable and combinable for various reasons including, but not limited to, optimizing performance of the diffuser 302.

Technical effects and benefits of the features described herein are the provision of a centrifugal compressor with improved exit flow conditions achieved by a flattened pressure profile that in turn result in improved diffuser performance.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A centrifugal compressor assembly of a gas turbine engine of an aircraft, the centrifugal compressor assembly comprising:

an impeller comprising a hub, vanes and a shroud surrounding the hub and the vanes to form a flow path from an inducer portion at an upstream side of the impeller to an exducer portion at an impeller exit;

a diffuser configured to direct compressed air from the impeller exit to a downstream combustor, the diffuser comprising a diffuser ring proximate to the impeller exit, each vane comprising, at the impeller exit, a trailing edge which is at least one of non-linear and angled, the shroud comprising a sloped trailing edge portion adjacent to the trailing edge of each vane, and the diffuser ring comprising a sloped surface adjacent to the sloped trailing edge portion of the shroud, wherein the sloped trailing edge portion of the shroud is sloped toward the trailing edge of each vane.

2. The centrifugal compressor assembly according to claim 1, wherein the trailing edge of each vane is non-linear with at least one of quadratic and high-order curvatures.

3. The centrifugal compressor assembly according to claim 1, wherein the trailing edge of each vane has a varying tip radius.

4. The centrifugal compressor assembly according to claim 1, wherein the trailing edge of each vane is radially outwardly angled from the hub to a distal tip of the sloped trailing edge portion of the shroud.

5. The centrifugal compressor assembly according to claim 1, wherein the trailing edge of each vane is concave and radially outwardly angled from the hub to a distal tip of the sloped trailing edge portion of the shroud.

6. The centrifugal compressor assembly according to claim 1, wherein the trailing edge of each vane is concave.

7. The centrifugal compressor assembly according to claim 1, wherein the trailing edge of each vane is convex.

8. The centrifugal compressor assembly according to claim 1, wherein the diffuser ring comprises the sloped surface, which is radially outwardly angled away from the sloped trailing edge portion of the shroud, and an annular surface opposite the trailing edge of each vane.

9. The centrifugal compressor assembly according to claim 1, wherein at least one of:

the trailing edge of each vane is radially outwardly angled from the hub to a distal tip of the sloped trailing edge portion of the shroud, the trailing edge of each vane is concave and radially outwardly angled from the hub to a distal tip of the sloped trailing edge portion of the shroud, the trailing edge of each vane is concave, the trailing edge of each vane is convex, and wherein the diffuser ring comprises the sloped surface, which is radially outwardly angled away from the sloped trailing edge portion of the shroud, and an annular surface opposite the trailing edge of each vane.

* * * * *